US008774420B2

(12) United States Patent
Belafonte et al.

(10) Patent No.: US 8,774,420 B2
(45) Date of Patent: Jul. 8, 2014

(54) HEADPHONES WITH EXPANDABLE SPEAKER ENCLOSURES

(75) Inventors: Stephen Belafonte, Hollywood, CA (US); Christopher Combest, Overland Park, KS (US); Chris Witham, Overland Park, KS (US); David Staley, Overland Park, KS (US)

(73) Assignee: Get Connected LLC, Overland Park, KS (US)

( * ) Notice: Subject to any disclaimer, the term of this patent is extended or adjusted under 35 U.S.C. 154(b) by 294 days.

(21) Appl. No.: 13/172,581

(22) Filed: Jun. 29, 2011

(65) Prior Publication Data

US 2013/0003984 A1 Jan. 3, 2013

(51) Int. Cl.
*H04R 1/10* (2006.01)

(52) U.S. Cl.
USPC ..... 381/74; 381/370; 381/371; 381/182

(58) Field of Classification Search
USPC ..... 381/74, 370–374, 379, 381–386
See application file for complete search history.

(56) References Cited

U.S. PATENT DOCUMENTS 7,388,960 B2 * 6/2008 Kuo et al. ..... 381/186
D610,572 S * 2/2010 Skurdal ..... D14/216
8,085,966 B2 * 12/2011 Amsel ..... 381/370
8,094,860 B2 * 1/2012 Huang ..... 381/386
8,284,972 B2 * 10/2012 Lin ..... 381/322
8,422,714 B2 * 4/2013 Peng ..... 381/345
2005/0185103 A1 * 8/2005 Woodard et al. ..... 348/739

* cited by examiner

*Primary Examiner* — Davetta W Goins
*Assistant Examiner* — Oyesola C Ojo
(74) *Attorney, Agent, or Firm* — Hovey Williams LLP

(57) ABSTRACT

A headphone set includes a head band and a pair of speaker assemblies supplied on opposite ends of the headband. Each of the speaker assemblies comprises an earphone speaker for reproducing sound to be directed toward one of the wearer's ears, a relatively larger and more powerful broadcast speaker for reproducing sound to be broadcast in the vicinity of the headphone set; and an expandable speaker enclosure for supporting the earphone speaker and the broadcast speaker. Each speaker enclosure defines a sound chamber having an enclosed air volume for improving the acoustical characteristics of the headphone set and each speaker enclosure is shiftable between a collapsed configuration and an expanded configuration. When the speaker enclosures are shifted to their expanded configurations, the sound chambers have a relatively larger enclosed air volume. When they are shifted to their collapsed configurations relatively smaller enclosed air volumes. This permits the sound chamber to be selectively increased in size when the larger broadcast speakers are operated and to be returned to their smaller size when only the earphone speakers are operated.

11 Claims, 10 Drawing Sheets

HEADPHONES WITH EXPANDABLE SPEAKER ENCLOSURES

BACKGROUND

Headphones allow listeners to listen to music, voices, or other audio content without disturbing others nearby. However, listeners sometimes wish to share their music or other audio content with others, but conventional headphones don't reproduce sounds at high enough volume levels for this purpose. Therefore, until recently, listeners had to use headphones for personal listening and separate loud speakers for group listening.

Headphones with larger, more powerful speakers and means for broadcasting sounds therefrom have been developed to eliminate the need for separate loud speakers in some applications. However, these headphones also suffer from several disadvantages that limit their utility.

SUMMARY

The present invention solves the above-described problems and provides a distinct advance in the art of headphones and loud speakers. More particularly, the present invention provides a headphone set that provides excellent sound reproduction for both personal listening and group listening.

An embodiment of the invention is a headphone set comprising a support band and a pair of speaker assemblies supported on opposite ends of the support band. The support band may be a headband with a central head-engaging portion, a pair of opposed ends, and a pair of swivel joints mounted on the ends for pivotally mounting the speaker assemblies. The support band and swivel joints permit the speaker assemblies to be selectively swiveled between a first position in which the headphone set may be worn in a conventional manner for private listening and a second position in which the headphone set may be placed on a table or other support surface with the speaker assemblies pointing upwardly.

Each of the speaker assemblies comprises an earphone speaker for reproducing sound to be directed toward one of the wearer's ears, a relatively larger and more powerful broadcast speaker for reproducing sound to be broadcast in the vicinity of the headphone set; and an expandable speaker enclosure for supporting the earphone speaker and the broadcast speaker.

Each speaker enclosure defines a first, fixed volume sound chamber for its earphone speaker and an expandable volume sound chamber for its broadcast speaker. More specifically, each speaker enclosure is shiftable between a collapsed configuration and an expanded configuration. When the speaker enclosures are shifted to their expanded configurations, the sound chambers for the broadcast speakers have a relatively larger enclosed air volume for optimizing the acoustical characteristics for group listening.

In one embodiment, each speaker enclosure includes a first rigid portion for supporting its earphone speaker, a second rigid portion for supporting its broadcast speaker, and a relatively flexible side wall positioned between the first and second rigid portions. Each speaker enclosure can be shifted to its expanded configuration by separating its first and second rigid portions and stretching the sidewall and then returned to its collapsed configuration by simply compressing the side wall and reconnecting the first and second rigid portions.

An embodiment of the headphone set may also comprise a switch for selectively switching the audio source input signal between the earphone speakers and the broadcast speakers and a latch positioned in each speaker enclosure for holding the speaker enclosures in their collapsed configurations. The latches may be coupled with the switch to automatically deliver the audio source input signal to the broadcast speakers whenever the speaker enclosures are shifted to their expanded positions. The latches and the switch may also be configured to automatically power the amplifiers and other driver circuitry for the broadcast speakers when the speaker enclosures are shifted to their expanded configurations and to disengage the amplifiers other driver circuitry for the broadcast speakers when the speaker enclosures are shifted to their collapsed positions.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
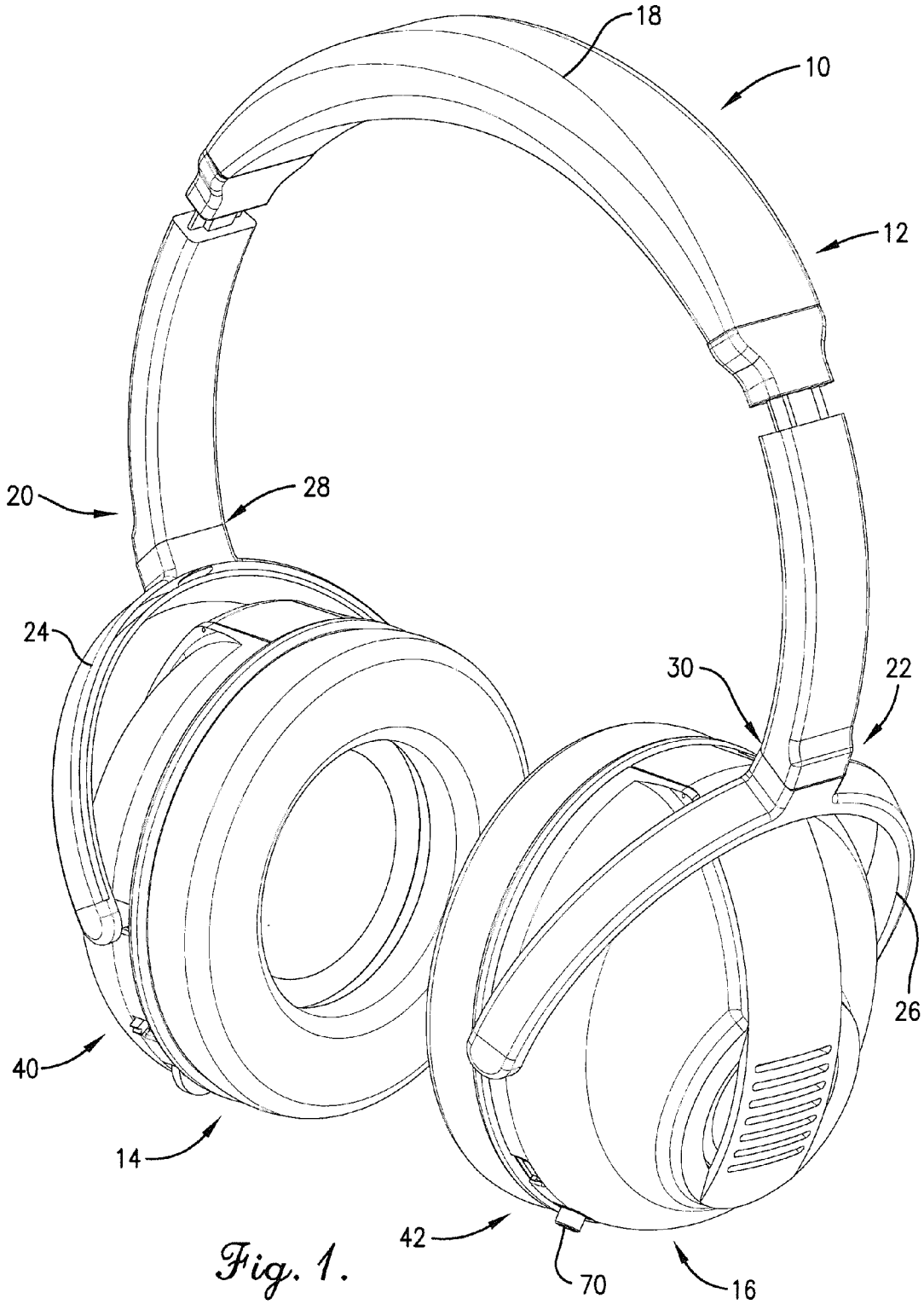
FIG. 1 is a perspective view of a headphone set constructed in accordance with an embodiment of the invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 2:
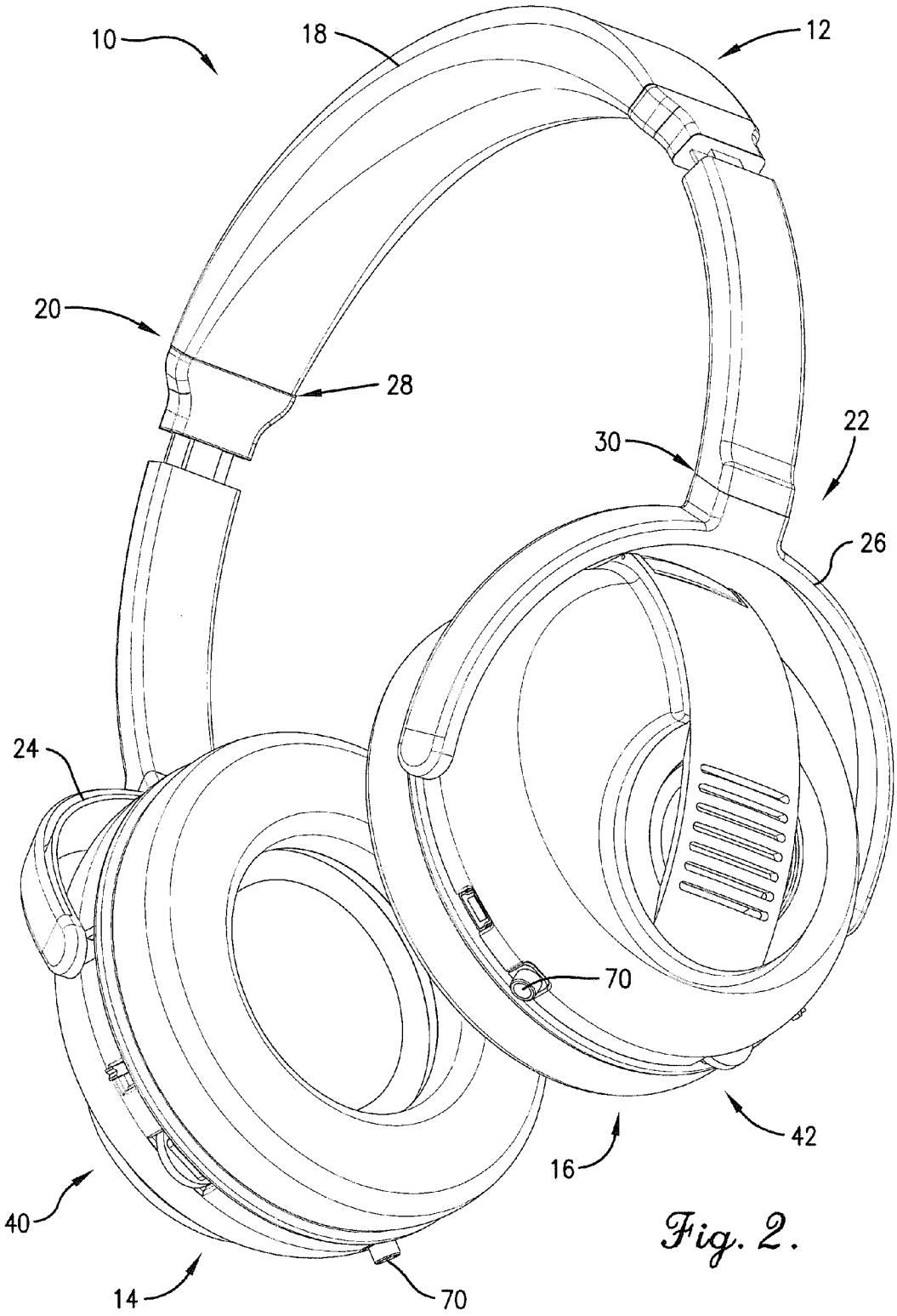
FIG. 2 is another perspective view of the headphone set from a different angle.
Figure 3:
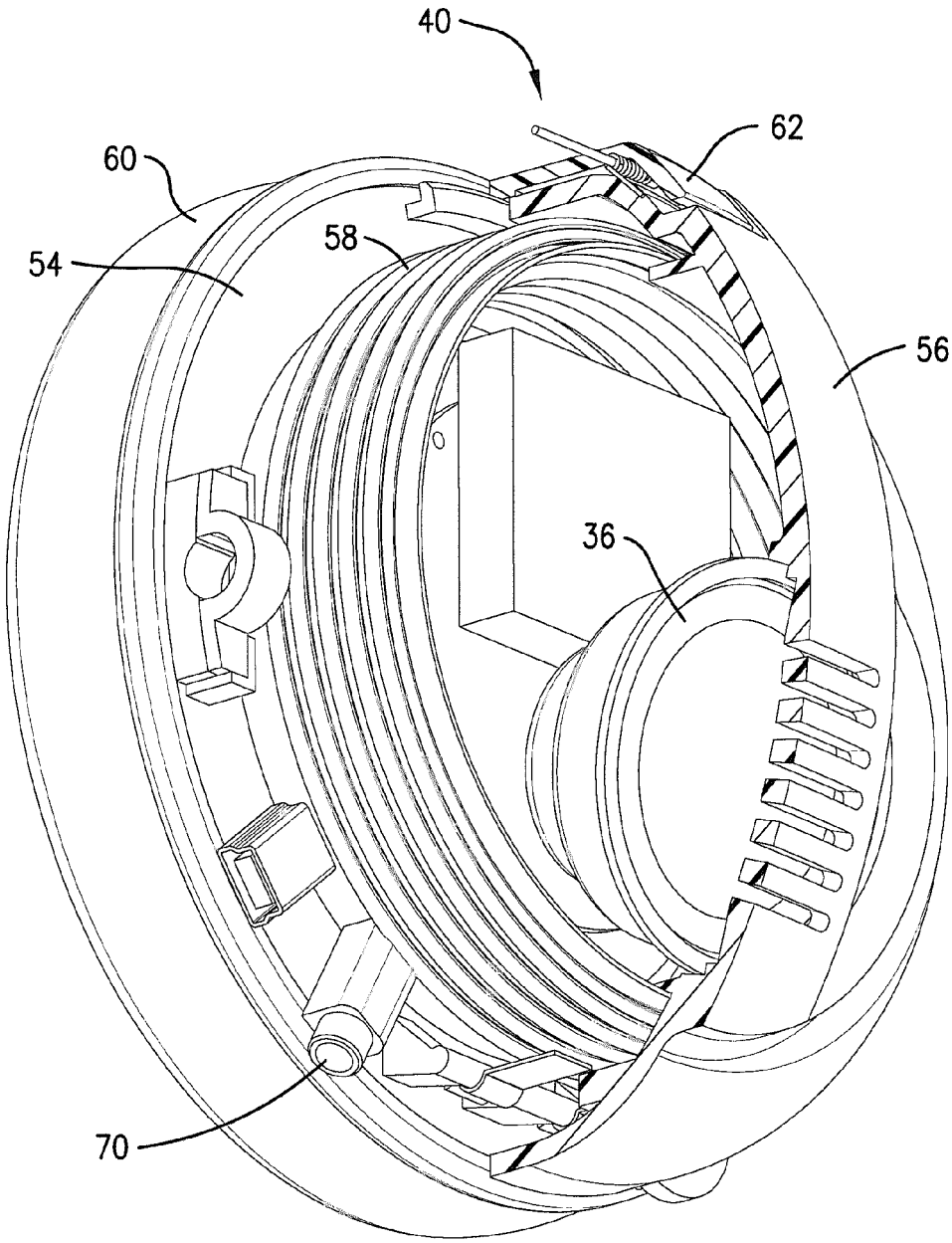
FIG. 3 is a perspective view in partial section of one of the speaker assemblies of the headphone set shown in its collapsed position.
Figure 4:
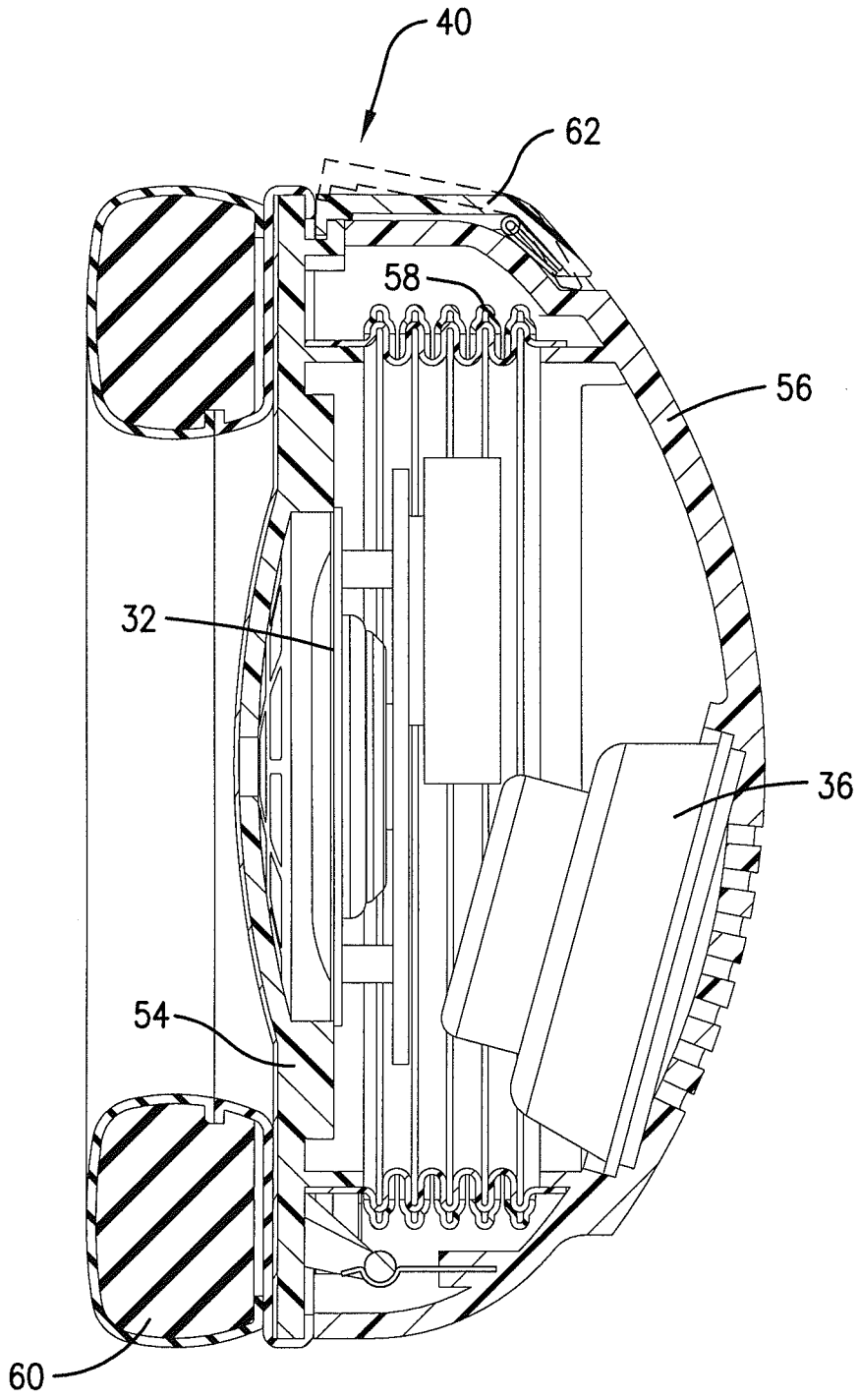
FIG. 4 is a vertical sectional view of one of the speaker assemblies in its collapsed configuration.
Figure 7:
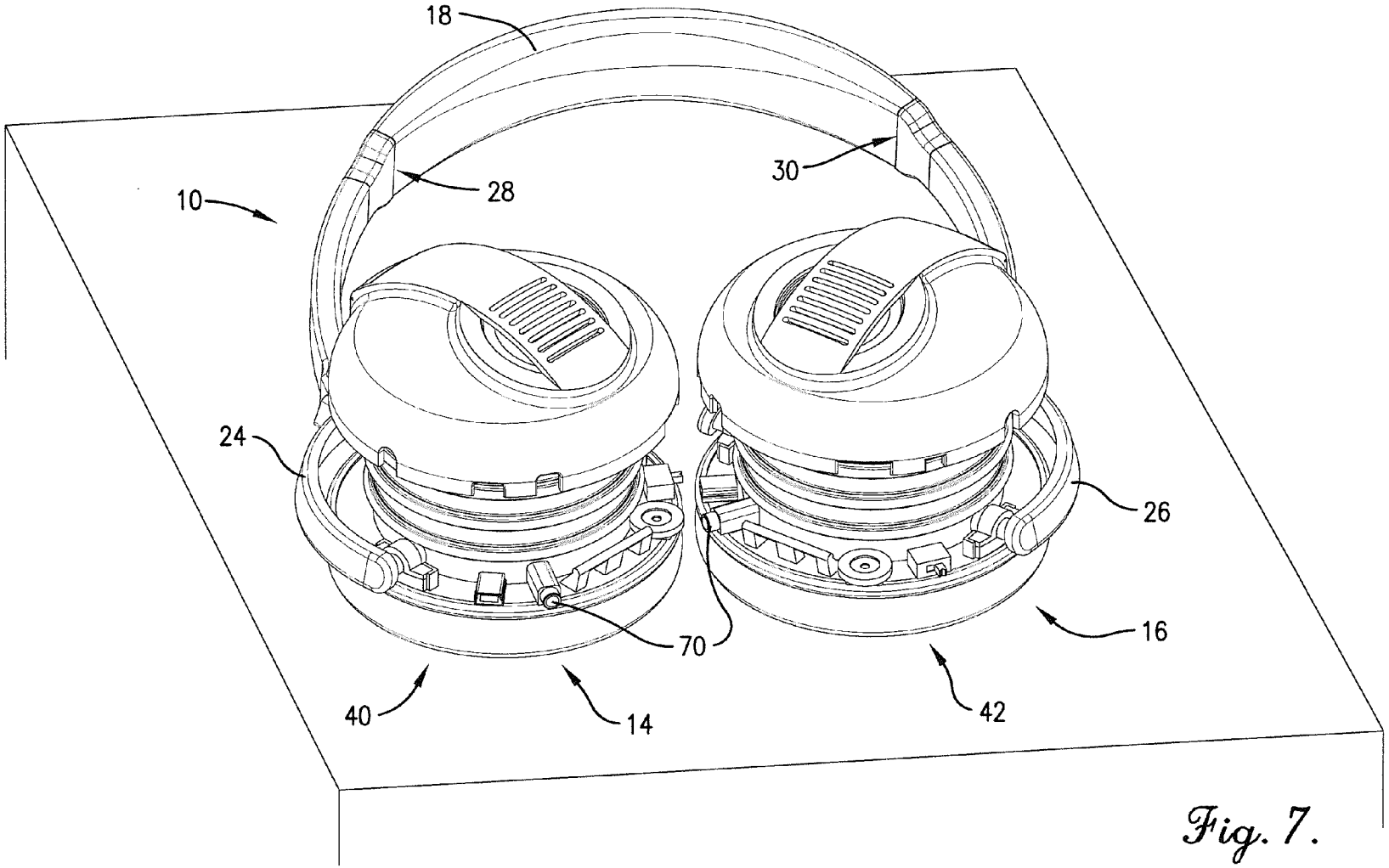
FIG. 7 is a perspective view of the headphone set shown with its two speaker assemblies in their expanded positions for group listening.
Figure 8:
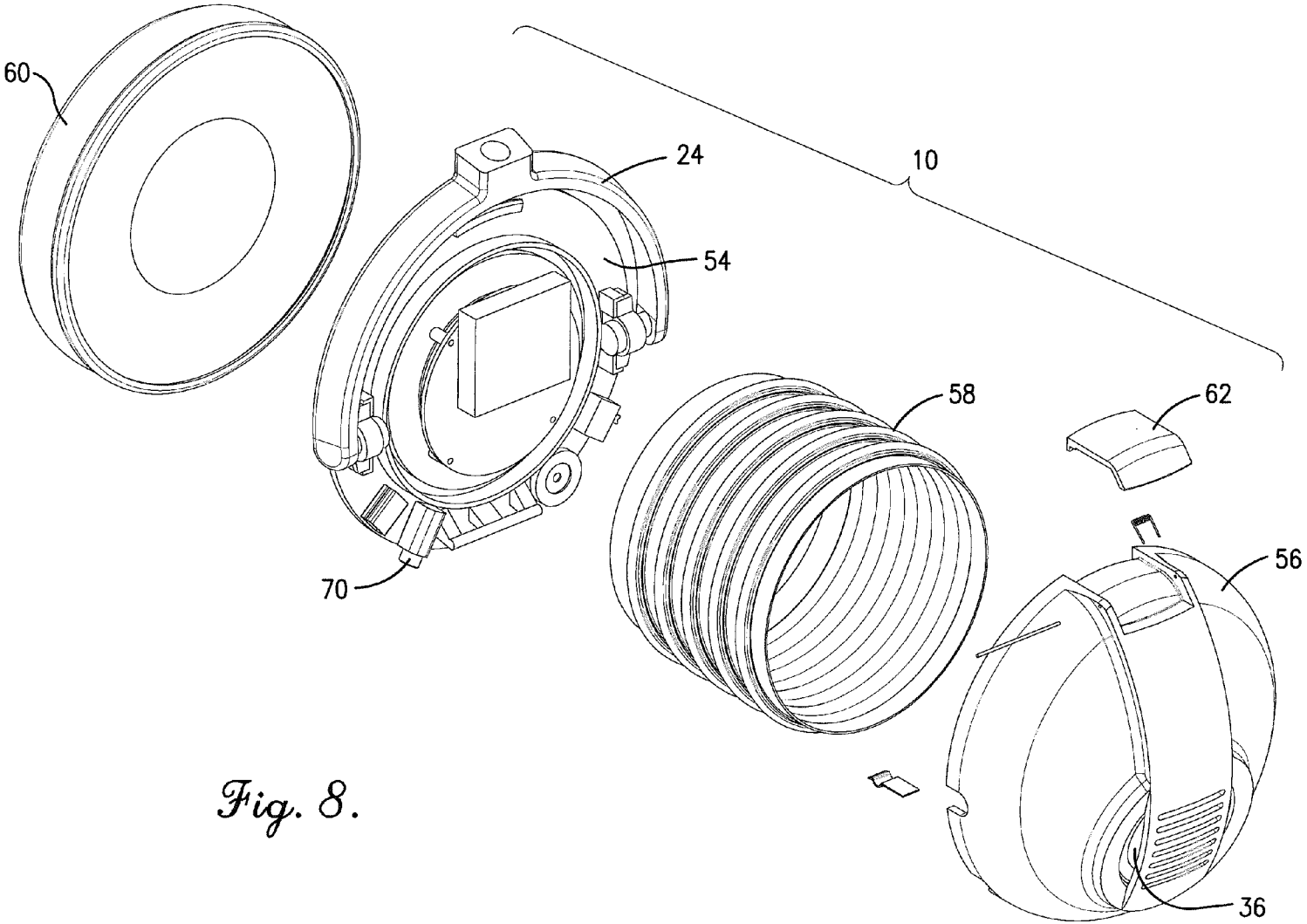
FIG. 8 is an exploded perspective view of one of the speaker assemblies.
Figure 9:
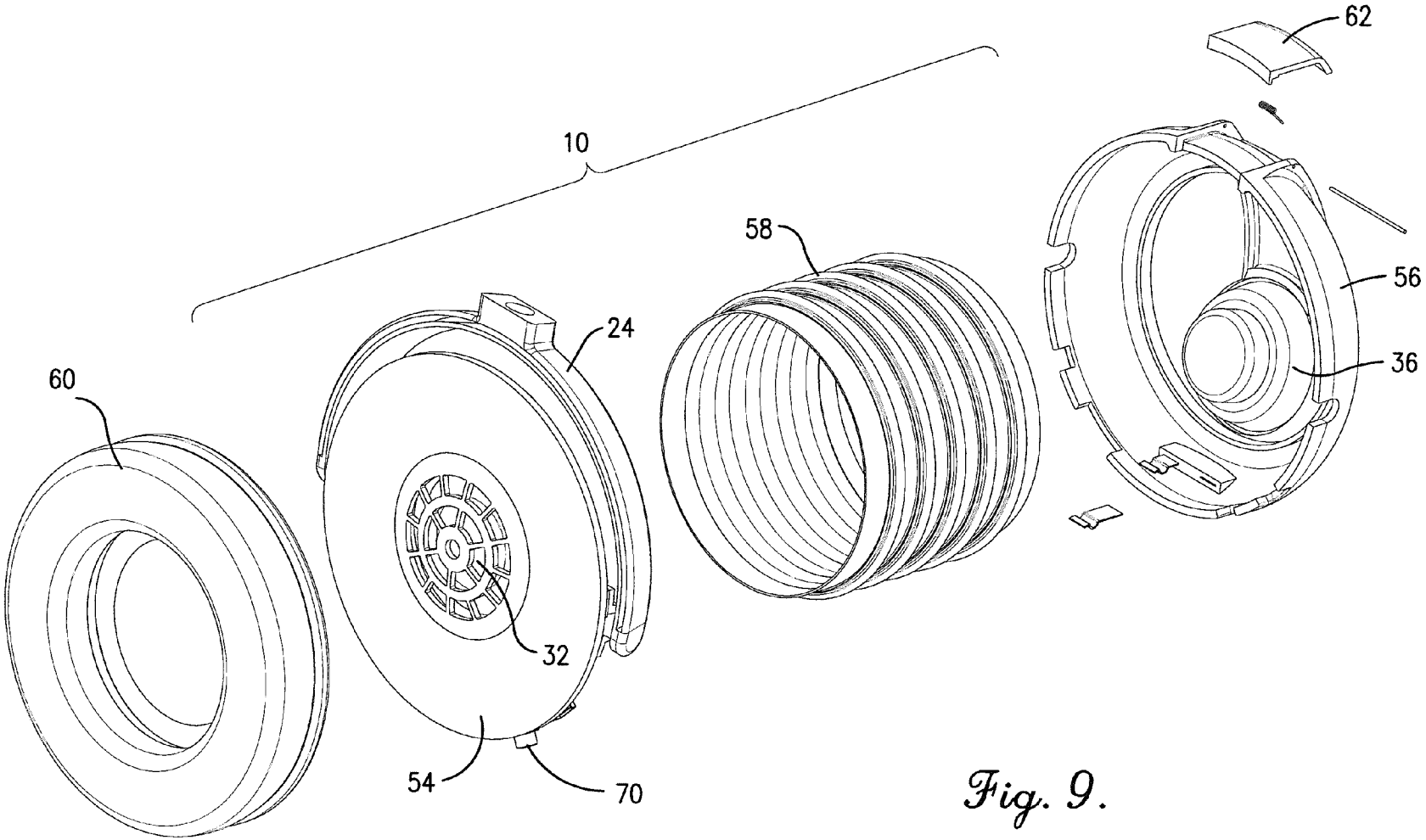
FIG. 9 is another exploded perspective view of one of the speaker assemblies shown from a different angle.

Turning now to the drawing figures, and particularly FIG. 1, a headphone set 10 constructed in accordance with an embodiment of the invention is illustrated. The headphone set may be worn for personal listening when oriented as shown in FIGS. 1 and 2 or placed on a table or other surface for group listening as shown in FIG. 7. An embodiment of the headphone set 10 broadly comprises a support band 12 and a pair of speaker assemblies 14, 16 supported on opposite ends of the support band.

The support band may be any device that supports the speaker assemblies over or in a listener's ears. In one embodiment, the support band is a headband comprising a central head-engaging portion 18, a pair of opposed ends 20, 22, and a pair of U-shaped arms 24, 26 that are connected to the ends 20, 22 by a pair of swivel joints 28, 30 for pivotally mounting the speaker assemblies on the ends. The U-shaped arms 24, 26 and swivel joints 28, 30 permit the speaker assemblies to be selectively swiveled between a first position illustrated in FIGS. 1 and 2 in which the headphone set may be worn in a conventional manner for private listening and a second position in which the headphone set may be placed on a table or other support surface with the speaker assemblies pointing upwardly. In other embodiments, the support band may be a neck band configured to partially encircle a listener's neck or ear bands that fit behind a listener's ears.

Figure 6:
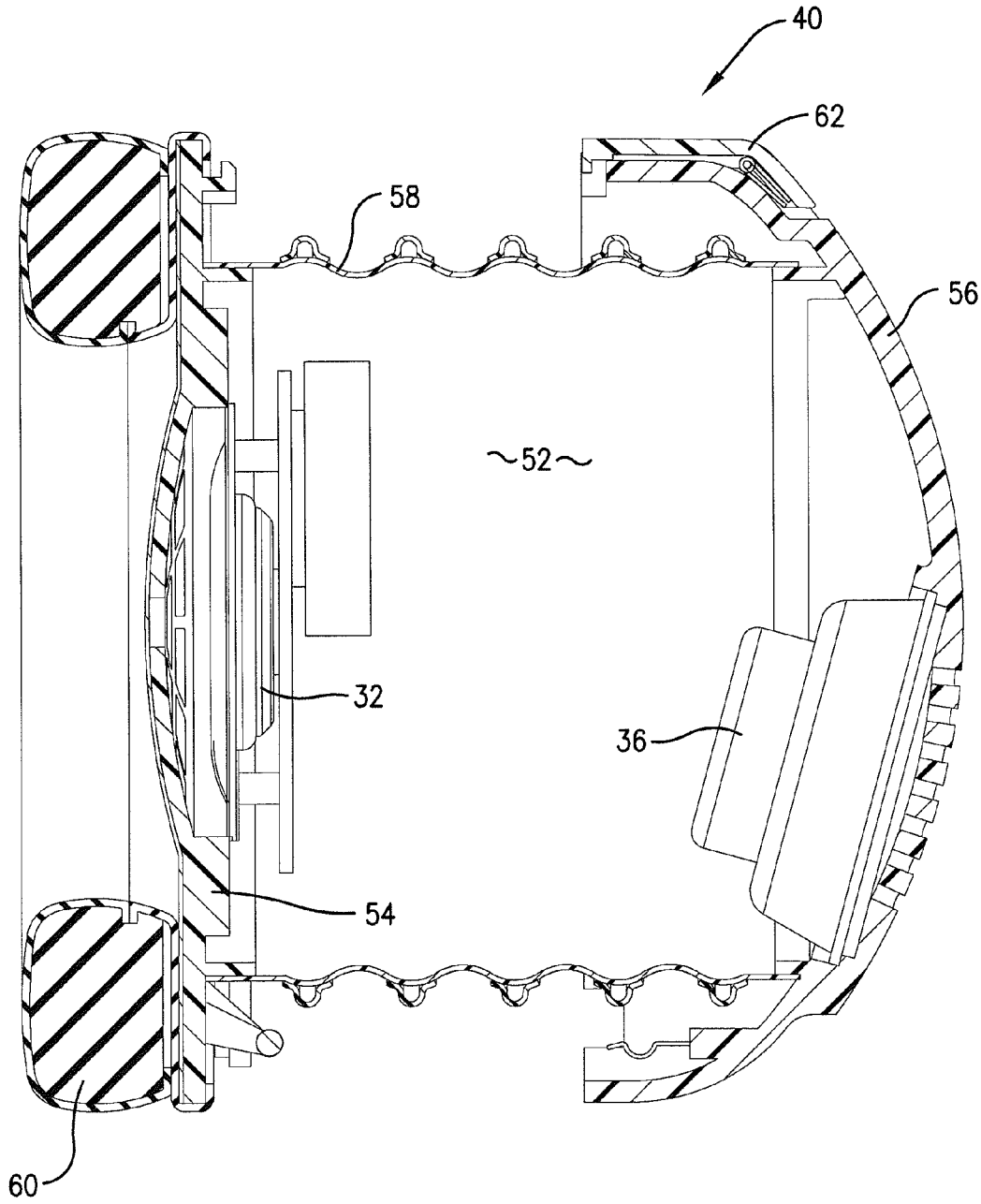
FIG. 6 is a vertical sectional view of one of the speaker assemblies in its expanded configuration.
Figure 10:
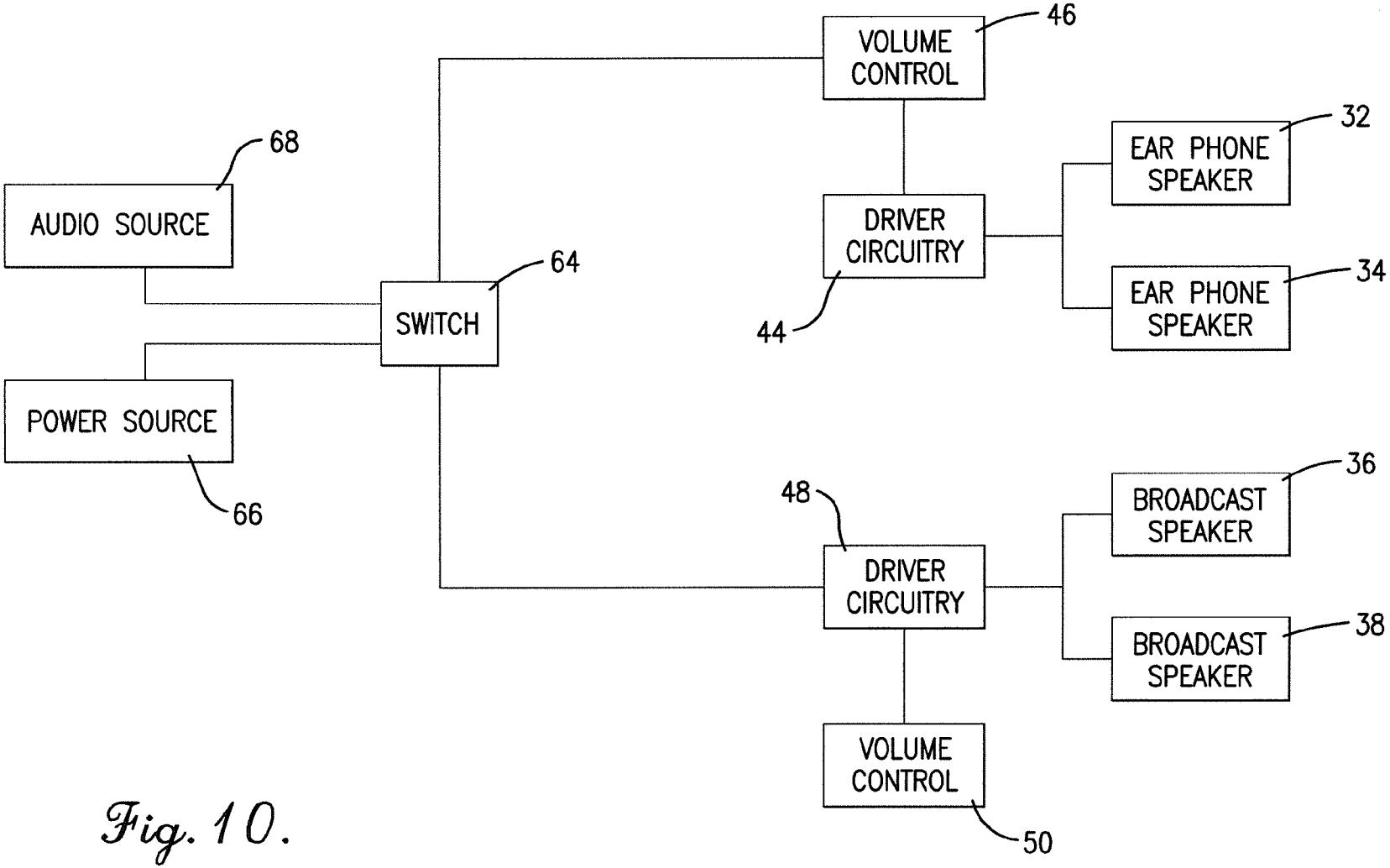
FIG. 10 is a block diagram of the primary active components of the headphone set.

As best shown in FIGS. 6 and 10, each of the speaker assemblies 14, 16 comprises an earphone speaker 32, 34, a broadcast speaker 36, 38, and an expandable speaker enclosure 40, 42. The two speaker assemblies 14, 16 are essentially identical, although they may each be configured to reproduce different portions of an audio signal as is conventional with stereo audio components.

Each earphone speaker 32, 34 is provided for reproducing sound to be directed toward one of the wearer's ears. The earphone speakers are conventional and may comprise any type of sound emitting devices suitable for use in headphones. For example, the earphone speakers may each include a speaker diaphragm that is driven by a voice coil and magnet assembly. The speakers may also include conventional suspension elements, horns, etc. The speakers may also use other sound emitting technology such as Sold Drive® technology that utilizes high-powered neodymium magnets and dual symmetrically opposed motors to convert audio signals into powerful vibrations that are transferred into surfaces by direct contact. The earphone speakers 32, 34 may be driven by the audio source signal only or they may have internal amplifiers and other driver circuitry 44 or be coupled with separate amplifiers and driver circuitry. The speakers, or the separate drive circuitry, may also be coupled with a conventional volume control switch 46 to permit volume adjustment of the speakers.

The broadcast speakers 36, 38 are provided for reproducing sound to be broadcast in the vicinity of the headphone set and are therefore relatively larger and more powerful than the earphone speakers. The broadcast speakers are conventional and may comprise any type of sound emitting devices. For example, as with the earphone speakers, the broadcast speakers may each include a speaker diaphragm that is driven by a voice coil and magnet assembly and may also include conventional suspension elements, horns, etc. The speakers may also use other sound emitting technology such as the Sold Drive® technology discussed above. The speakers may have internal amplifiers and other driver circuitry 48 or may be coupled with separate amplifiers and driver circuitry. The speakers, or the separate drive circuitry, may also be coupled with a conventional volume control switch 50 to permit volume adjustment of the speakers.

Figure 5:
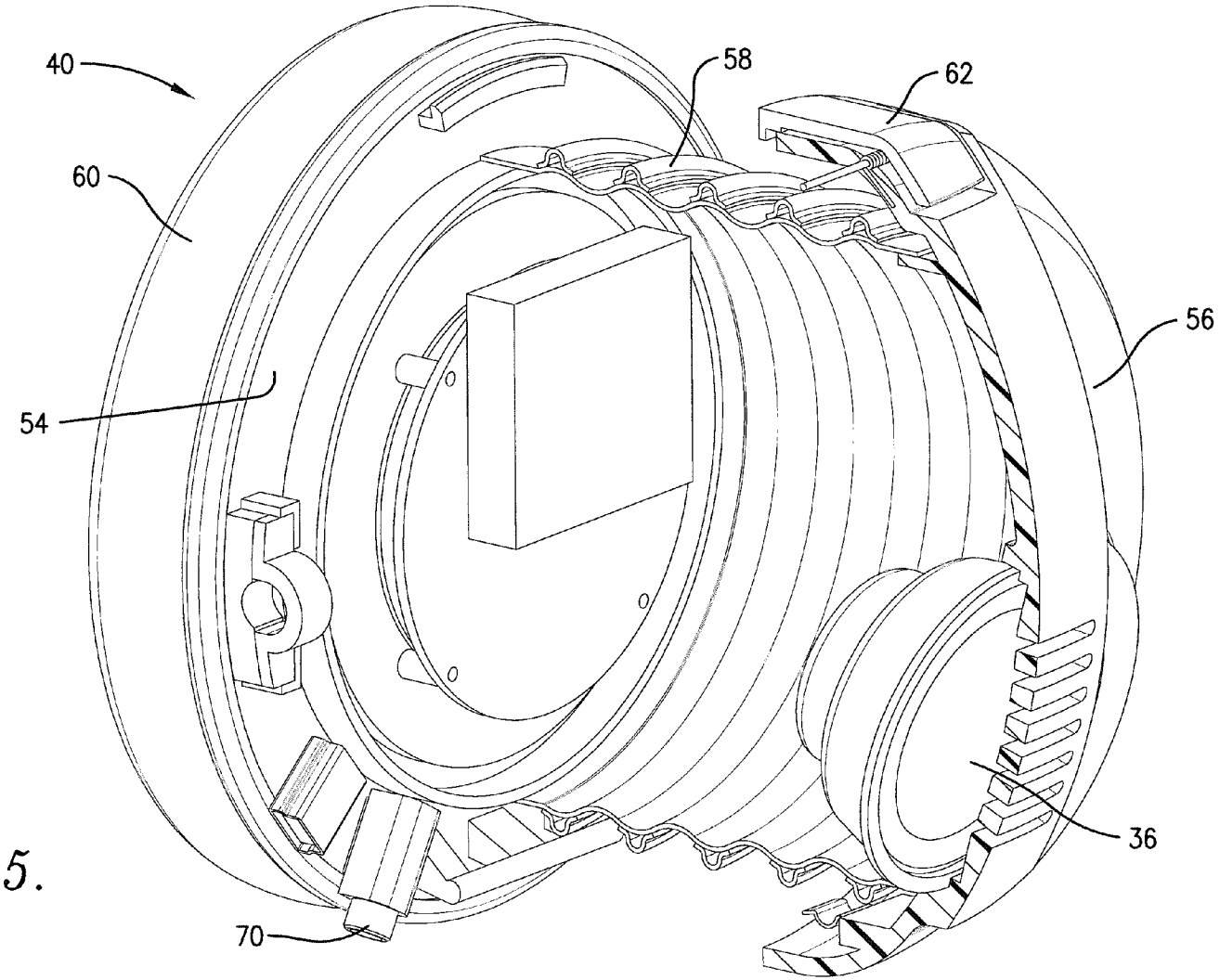
FIG. 5 is a perspective view in partial section of one of the speaker assemblies in its expanded configuration.

The expandable speaker enclosures 40, 42 support the earphone speakers, the broadcast speakers, and the other components of the headphone set. The speaker enclosures 40, 42 are identical so only one is described in detail herein. The speaker enclosure 40 defines a fixed volume sound chamber for its earphone speaker and an expandable volume sound chamber 52 for its broadcast speaker. Importantly, each speaker enclosure is shiftable between a collapsed configuration shown in FIGS. 1-4 and an expanded configuration shown in FIGS. 5-7.

When the speaker enclosures are shifted to their expanded configurations, the sound chambers 52 for the broadcast speakers have a relatively larger enclosed air volume. Conversely, when the enclosures are shifted to their collapsed configurations, the sound chambers 52 have relatively smaller enclosed air volumes. This permits the enclosures and sound chambers 52 to be selectively increased in size when the larger broadcast speakers are operated to improve the acoustical characteristics of the headphone set for group listening.

In one embodiment, each speaker enclosure includes a first rigid portion 54 for supporting its earphone speaker, a second rigid portion 56 for supporting its broadcast speaker, and a relatively flexible side wall 58 that connects the first and second rigid portions. A soft, flexible ear cover 60 may be attached to the first rigid portion of each speaker enclosure for making the headphone set more comfortable to wear. The ear covers also serve as dampening elements for improving the sound of the corresponding broadcast speakers when the speaker assemblies are positioned with the first rigid portions facing down on a table or other support surface as described in more detail below.

The headphone set also includes a spring-biased latch 62 positioned between the first and second rigid portions of each speaker enclosure for holding the speaker enclosures in their collapsed configurations. The latch 62 may be any component or combination of components that hold the first and second rigid portions together and permit them to be released and separated. The speaker enclosures can be shifted to their expanded configurations by operating the latches separating the first and second rigid portions.

An embodiment of the headphone set may also comprise a switch 64 for selectively switching the audio source input signals from an audio source 68 between the earphone speakers and the broadcast speakers. The switch may be coupled with the latches to automatically power the amplifiers and/or other drive circuitry of the broadcast speakers when the latches are operated to shift the speaker enclosures to their expanded positions. The latches and the switch may also be configured to automatically disengage the amplifiers and drive circuitry for the broadcast speakers when the speaker enclosures are shifted to their collapsed positions.

The headphone set also includes an input connection 70 for receiving an audio jack and wire connected to an audio source such as an MP3 player, radio, TV or computer. Alternatively, the headphone set may receive audio signals wirelessly via a Bluetooth connection or other wireless connection. In yet another embodiment, the headphone set may include an internal or integral MP3 player, radio, or other audio source.

The headphone set may also include another input jack connection for receiving an input jack on an audio cable for connecting to other identical headphone sets in a daisy-chain fashion so that multiple headphone set may be connected to a single audio source.

The headphone set may also include one or more LED lights positioned inside each of the speaker enclosures. The flexible side wall 58 may be translucent, or opaque, such that the light from the LEDs will be visible outside the speaker enclosures. The light may come on when the driver circuitry 48 is powered up, signifying that the broadcast speaker amplifiers are turned on. Multi-colored LEDs and a selector switch may also be provided so that a user may choose the color, or colors, emitted by the LEDs. The LEDs may also be controlled so as to cycle through all of the available colors, and to do this to the rhythm of the music being played. This will create an effect within the speaker chamber similar to that found at a dance parties or night clubs.

The speaker enclosures may also each have an interchangeable cover that will allow users to select different colored cover plates. This will give users the ability to customize their headphone set. The cover plate will not be integral to the function of the headphone or external speaker and will serve solely for customization of the unit.

In use, the headphone set 10 may be worn and used like conventional headphones when the speaker assemblies are shifted to their collapsed positions. When it is desired to use the headphone set for group listening, the speaker assemblies 14, 16 may be pivoted or twisted relative to the ends of the support band 12 so that the first rigid portions of the speaker enclosures and their ear covers 60 lay on top of a table or other surface as illustrated in FIG. 7. The latches on the speaker enclosures may then be operated so that the enclosures may be shifted to their expanded positions. As described above, operating the latches causes the switch to power the broadcast speakers so that more than one person can listen to audio content. Shifting the enclosures to their expanded positions also enlarges the sound chambers to improve the acoustical response of the broadcast speakers.

Because the ear covers 60 are soft and flexible, they seal the speaker assemblies 14, 16 to the listener's head when the headset is used for personal listening. The ear covers also serve to isolate the headphone set from vibrations and therefore increase its performance when it is used for group listening. Orienting the broadcast speakers in a vertical direction also provides optimal off-axis acoustic performance. Also, because the headphone set 10 is supported on the soft ear covers 60, it won't move or bounce on the surface it is resting on due to the vibrations of the speakers when the broadcast speakers are being played.

Once it is desired to use the headphone set for personal listening again, the speaker enclosures may be shifted to their collapsed positions and held in this configuration by the latch. Closing of the latch causes the switch to remove power from the broadcast speakers and power the earphone speakers instead. The speaker assemblies may then be pivoted or twisted relative to the ends of the support band so that the ear covers again face one another.

By constructing a headphone set as described herein, numerous advantages are realized. For example, the headphone set is configured to provide excellent sound reproduction for both personal listening and group listening.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A headphone set comprising:
- a support band; and
- a pair of speaker assemblies supported on opposite ends of the support band, each of the speaker assemblies comprising:
  - a first rigid portion;
  - an earphone speaker mounted on the first rigid portion for reproducing sound to be directed toward one of a wearer's ears;
  - a second rigid portion, the first and second rigid portions presenting a space therebetween;
  - a broadcast speaker mounted on the second rigid portion for reproducing sound to be broadcast in the vicinity of the headphone set; and
  - an expandable speaker enclosure formed of a continuous piece of relatively flexible material and connected to the first rigid portion at a first end and connected to the second rigid portion at a second end, the enclosure, first section, and second section cooperatively at least partially enclosing the space, the speaker enclosure being shiftable between a collapsed configuration in which the expandable speaker enclosure is compressed and an expanded configuration in which the expandable speaker enclosure is stretched so as to increase an area of the space and to increase a distance between the first rigid portion and the second rigid portion, and hence the earphone speaker and the broadcast speaker, when the enclosure is in the expanded configuration.

2. The headphone set as set forth in claim 1, wherein each speaker enclosure defines a sound chamber having an enclosed air volume, wherein the sound chamber has a relatively larger enclosed air volume when the speaker enclosure is shifted to its expanded configuration and a relatively smaller enclosed air volume when the speaker enclosure is shifted to its collapsed configuration.

3. The headphone set as set forth in claim 1, wherein the first rigid section and the second rigid section are secured to each other when the enclosure is in the collapsed configuration.

4. The headphone set as set forth in claim 1, further comprising a switch for selectively delivering power to the earphone speakers or the broadcast speakers.

5. The headphone set as set forth in claim 4, further comprising a latch positioned in each speaker enclosure for holding its speaker enclosure in its collapsed configuration and, when operated, for permitting its speaker enclosure to be shifted to its expanded configuration.

6. The headphone set as set forth in claim 5, wherein the latches are coupled with the switch to automatically deliver power to the broadcast speakers when the speaker enclosures are shifted to their expanded positions.

7. The headphone set as set forth in claim 6, wherein the latches and the switch automatically disconnect power to the broadcast speakers and deliver power to the earphone speakers when the speaker enclosures are shifted to their collapsed positions.

8. The headphone set as set forth in claim 1, the support band comprising a headband having a central head-engaging portion, a pair of opposed ends, and a pair of swivel joints mounted on the ends for pivotally mounting the speaker assemblies so they may be selectively swiveled between a first position in which the headphone set may be worn and a second position in which the headphone set may be placed on a table or other support surface with the speaker assemblies pointing upwardly.

9. A headphone set comprising:

a headband comprising:

a central head-engaging portion;

a pair of opposite ends; and a pair of swivel joints mounted on the opposite ends, respectively;

a pair of speaker assemblies pivotally mounted on the swivel joints and configured to be selectively swiveled between a first position in which the headphone set may be worn and a second position in which the headphone set may be placed on a surface with the speaker assemblies pointing upwardly, each of the speaker assemblies comprising:

a first rigid portion having a soft cushion for contacting a user's ear, the first rigid portion being attached to the headband;

an earphone speaker connected to the first rigid portion for reproducing sound to be directed toward one of a wearer's ears, a second rigid portion;

a broadcast speaker connected to the second rigid portion for reproducing sound to be broadcast in the vicinity of the headphone set;

an expandable speaker enclosure formed of a continuous piece of relatively flexible material connected to the first rigid portion at a first end and the second rigid portion at a second end and including a plurality of bellows each including a reinforcement rib, the expandable speaker enclosure being operable to partially enclose the earphone speaker and the broadcast speaker and being shiftable between a collapsed configuration in which the expandable speaker enclosure is compressed and an expanded configuration in which the expandable speaker enclosure is stretched, the expandable speaker enclosure, the first rigid portion, and the second rigid portion cooperatively defining a sound chamber having an enclosed air volume; and a latch for holding the speaker enclosure in its collapsed configuration and, when operated, for permitting the speaker enclosure to be shifted to its expanded configuration; and a switch for selectively delivering power to the earphone speakers or the broadcast speakers, wherein the switch is operated by at least one of the latches to automatically deliver power to the broadcast speakers when the expandable enclosures are shifted to their expanded configurations, the latch of each speaker assembly and the switch being cooperatively configured to automatically disconnect power to the broadcast speakers and deliver power to the earphone speakers when the expandable enclosures are shifted to their collapsed configurations.

10. A headphone set comprising:

a support band;

a pair of speaker assemblies supported on opposite ends of the support band, each of the speaker assemblies comprising:

an earphone speaker for reproducing sound to be directed toward one of a wearer's ears;

a broadcast speaker for reproducing sound to be broadcast in the vicinity of the headphone set;

an expandable speaker enclosure formed of a continuous piece of relatively flexible material and including a plurality of bellows each including a reinforcement rib, the expandable speaker enclosure being operable to at least partially enclose the earphone speaker and the broadcast speaker, the speaker enclosure being shiftable between a collapsed configuration in which the expandable speaker enclosure is compressed and an expanded configuration in which the expandable speaker enclosure is stretched; and a latch for holding the speaker enclosure in its collapsed configuration and, when operated, for permitting the speaker enclosure to be shifted to its expanded configuration; and at least one switch for selectively delivering power to at least one of the earphone speakers or at least one of the broadcast speakers, wherein the switch is operated by at least one of the latches to automatically deliver power to at least one of the broadcast speakers when at least one of the expandable enclosures is shifted to its expanded position.

11. The headphone set of claim 10, wherein the at least one switch comprises two switches, each switch for selectively delivering power to a respective earphone speaker and a respective broadcast speaker, each switch being mounted on a respective speaker assembly and being operated by a respective latch to automatically deliver power to a respective earphone speaker when a respective speaker enclosure is shifted to its expanded position.

* * * * *